US007325991B2

(12) United States Patent
Holloway

(10) Patent No.: US 7,325,991 B2
(45) Date of Patent: Feb. 5, 2008

(54) COSMETIC DISPENSER WITH FRICTIONAL DRAG

(76) Inventor: Thomas F. Holloway, 866 Peter Rd., Southbury, CT (US) 06488

( * ) Notice: Subject to any disclaimer, the term of this patent is extended or adjusted under 35 U.S.C. 154(b) by 0 days.

(21) Appl. No.: 11/166,874

(22) Filed: Jun. 24, 2005

(65) Prior Publication Data

US 2006/0291948 A1 Dec. 28, 2006

(51) Int. Cl.
*B43K 21/00* (2006.01)

(52) U.S. Cl. ..... 401/78; 401/80; 401/84

(58) Field of Classification Search ..... 401/74, 401/77, 78, 80, 84

See application file for complete search history.

(56) References Cited

U.S. PATENT DOCUMENTS 5,186,560 A 2/1993 Holloway
5,186,561 A 2/1993 Ackermann et al.
5,324,126 A 6/1994 Holloway et al.
5,348,410 A 9/1994 Shozi et al.
5,791,799 A * 8/1998 Oehlhorn ..... 401/78
5,851,078 A 12/1998 Bow et al.
6,200,049 B1 3/2001 Pinhel et al.
6,412,999 B1 * 7/2002 Pierpont ..... 401/74

* cited by examiner

*Primary Examiner*—Huyen Le
(74) *Attorney, Agent, or Firm*—O'Connell Law Firm

(57) ABSTRACT

A cosmetic dispenser for axially moving a volume of cosmetic between an extended disposition and a retracted disposition with an elevator member, an innerbody with an open inner volume for receiving the elevator member, and a spiral member with an open inner volume for receiving a body portion of the innerbody in a relatively rotatable relationship. At least one protuberance, which can be inflexible, can project from a shoulder portion of the innerbody and can be axially aligned with a flexible wall segment of the spiral member thereby to produce a frictional drag between the innerbody and the spiral member. The flexible wall segment of the spiral member can comprise a proximally disposed skirt. Axial movement of the elevator member can be produced by opposed lugs that project from the elevator member through opposed longitudinal tracks in the innerbody and into engagement with opposed spiral threads on the spiral member.

20 Claims, 5 Drawing Sheets

COSMETIC DISPENSER WITH FRICTIONAL DRAG

FIELD OF THE INVENTION

The present invention relates generally to cosmetic containers and dispensers. Stated more particularly, disclosed herein is a device for containing and dispensing cosmetics with a frictional drag exhibited between relatively rotatable components.

BACKGROUND OF THE INVENTION

In a typical prior art lipstick dispenser, an elevator cup retains a body of lipstick for axial extension and retraction by a swiveling of a base portion in relation to a body portion of the dispenser. Dispensers have commonly employed a cam member with helical threads formed there along that is rotatably associated with a tubular innerbody. The innerbody is normally formed with opposed longitudinal tracks. The elevator cup typically has opposed lugs that are received through the longitudinal track and associated with the helical threads of the cam member. Under this arrangement, a rotation of the cam member in relation to the tubular innerbody induces the desired axial movement of the elevator cup and the retained body of lipstick as the lugs of the elevator cup slide along the helical threads and the longitudinal tracks.

This basic lipstick dispensing design has demonstrated plural disadvantages that have been well recognized in the cosmetic industry. For example, there can be axial and radial looseness between the various components of the lipstick dispenser that can lead to a perceived lack of quality of the device and, by inference, the retained product. The lipstick product can also be perceived as being inferior when the swivel torque required to operate the dispenser is excessively light or inconsistent. Still further, a loosely retained elevator cup can wobble thereby resulting in damage to the product and again reducing the perceived quality thereof.

Conversely, it has been found that a lipstick mechanism with a smooth feel and with consistent torque characteristics lends a perception of quality to the device with a resultant increase in the perceived value of the product. A frictional drag of sufficient significance imparts a firm feel to the device that gives an impression of luxury. Preferably, the frictional drag will remain generally constant during extension and retraction of the lipstick and without regard to whether the dispenser is substantially full or substantially exhausted of cosmetic.

Prior art inventors have proposed numerous arrangements for meeting these needs and goals. In one construction, flexible tabs have portions that project radially from the innerbody to provide a frictional engagement with the cam or spiral member. That frictional engagement is intended to provide the dispenser with the desired braking effect and constant swivel torque. Other arrangements have produced a similar frictional engagement by the introduction of fins or ribs on the innerbody. It has been found, however, that the tabs and ribs can plastically deform over time thereby losing effectiveness. Additionally, certain of these arrangements can yield an inconsistent swivel torque during travel of the elevator cup since the effective diameter of the relatively moveable components can vary along their length thereby changing the frictional drag in an undesirable manner.

Another problem exhibited by many prior art lipstick dispensers is an unintentional retraction of the elevator cup during use of the dispenser. In such a situation, the force necessary to apply the lipstick tends to drive the elevator cup toward a retracted position as the lugs slip down the helical threads of the cam member. This retraction has been prevented by the provision of a lateral locking track at the distal end of the innerbody longitudinal track. However, when the dispenser is anything other than fully extended, the locking track is inoperative such that inadvertent retraction is not prevented.

Based on the state of the art as summarized above, it becomes clear that there remains a need for an improved cosmetic dispenser that overcomes the difficulties that have been demonstrated by devices of the prior art while providing additional, heretofore unrealized advantages thereover.

SUMMARY OF THE INVENTION

The present invention has as its most broadly stated object the providing of a dispenser for cosmetics, such as lipsticks, that overcomes the disadvantages from which the prior art has suffered while achieving previously unrealized advantages thereover.

A more particular object of embodiments of the invention is to provide a cosmetic dispenser that extends and retracts a cosmetic smoothly and with consistent swivel torque characteristics.

Another object of embodiments of the invention is to provide a cosmetic dispenser that demonstrates a frictional drag during operation of the dispenser to impart a firm feel to the user.

A further object of embodiments of the invention is to provide a cosmetic dispenser that minimizes perceptible looseness and play between components.

A resultant object of embodiments of the invention is to provide a cosmetic dispenser that provides an impression of quality and luxury to the user.

Still another object of embodiments of the invention is to provide a cosmetic dispenser that conserves materials and is relatively efficient in construction, assembly, and operation.

These and further objects and advantages of embodiments of the invention will become obvious not only to one who reviews the present specification and drawings but also to one who has an opportunity to make use of an embodiment of the cosmetic dispenser disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

One exemplary embodiment of the cosmetic dispenser employs an innerbody and a spiral member to produce an axial movement of an elevator member and a retained volume of cosmetic, such as a member of lipstick, between an extended disposition and a retracted disposition. The elevator member can have a cosmetic retaining portion comprising an elevator cup that can be defined by a peripheral wall and a base portion. At least one elevator lug can project radially from the elevator cup. The innerbody can have a proximal portion, a distal portion, a body portion with an inner wall surface and an outer wall surface, and an open inner volume for receiving at least a portion of the elevator member. The spiral member can have a proximal portion, a distal portion, a body portion with an inner wall surface and an outer wall surface, an open inner volume for receiving a portion of the innerbody in a relatively rotatable, mating relationship, and an annular flexible wall segment with a nonbiased inner diameter.

At least one protuberance, which can be inflexible, can project from the outer wall surface of the innerbody in axial alignment with the flexible wall segment of the spiral member. The protuberance or protuberances can establish an effective radius of the innerbody including the protuberance or protuberances that is greater than the nonbiased inner radius of the flexible wall segment. As a result, frictional drag will tend to be produced between the innerbody and the spiral member. The at least one protuberance will slide along the flexible wall segment to engage and outwardly bias a localized portion of the flexible wall segment while drawing opposing portions of the flexible wall segment toward the innerbody.

An axial movement of the elevator member in response to a rotation of the innerbody relative to the spiral member can be produced by any effective means. In one construction, the means can take the form of at least one spiral thread disposed along the inner wall surface of the spiral member in combination with at least one elevator lug that projects from the elevator member for being received through a longitudinal track in the innerbody and into engagement with the at least one spiral thread. First and second longitudinal tracks can be disposed in general opposition in the body portion of the innerbody, and first and second elevator lugs can project in general opposition from the elevator member for being received through the longitudinal tracks and into engagement with opposed spiral threads. In certain embodiments, lateral track segments can be disposed adjacent to either or both of the proximal and distal ends of each longitudinal track for enabling the elevator lugs and the elevator member to be locked in retracted and extended dispositions.

The innerbody can have a distally disposed body portion, a proximally disposed knob portion, and a shoulder portion that can be disposed therebetween. The body portion of the innerbody can be received through a body portion of the spiral member, and a retaining lip at the distal end of the body portion of the innerbody can retain the innerbody and the spiral member in rotatable engagement. The knob portion can have an outer radius greater than the outer radius of the flexible wall segment such that the knob portion can form a proximal portion of the cosmetic dispenser. In such manifestations of the invention, the at least one protuberance can project from the shoulder portion and each can be substantially inflexible. The shoulder portion can be smaller in outer radius without the at least one protuberance than the axially aligned inner radius of the flexible wall segment of the spiral member.

The flexible wall segment can take the form of a skirt, which can comprise the proximal portion of the spiral member. The outer radii of the shoulder portion and the inner diameter of the flexible wall segment can be generally constant or can vary, such as by being conical or otherwise shaped. Where just one protuberance is incorporated, the protuberance can bias the portion of the flexible wall segment adjacent to the protuberance outwardly while biasing portions of the flexible wall segment in opposition to the protuberance toward contact and conformity with the outer wall surface of the innerbody.

With certain embodiments of the present invention for a cosmetic dispenser summarily described, one will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a cosmetic dispenser with frictional drag is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
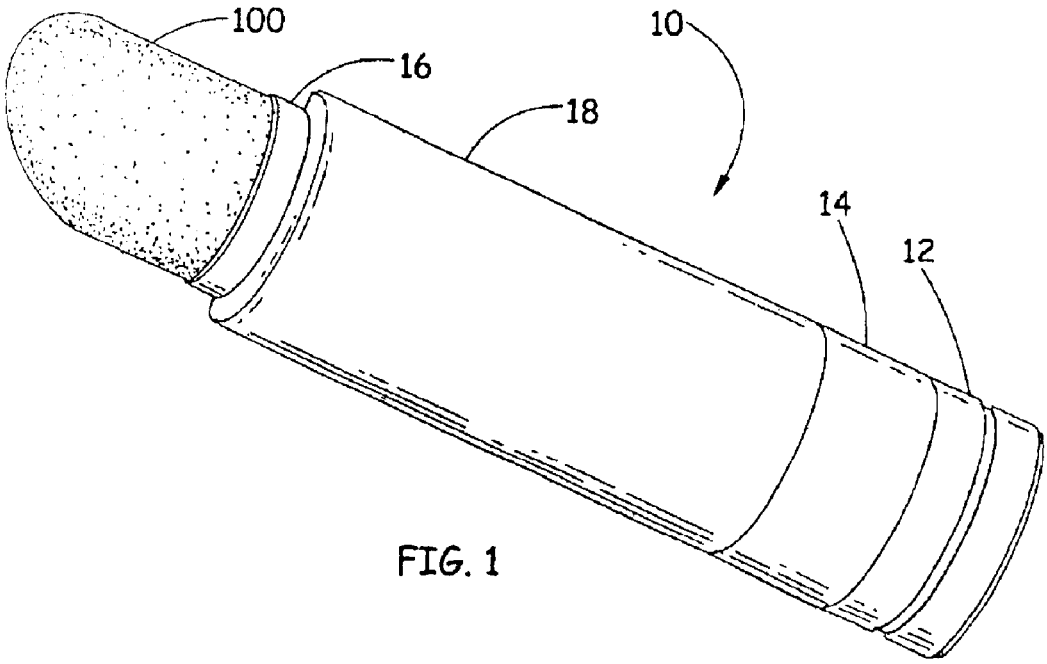
FIG. 1 is a perspective view of a cosmetic dispenser with frictional drag according to the present invention.
Figure 2:
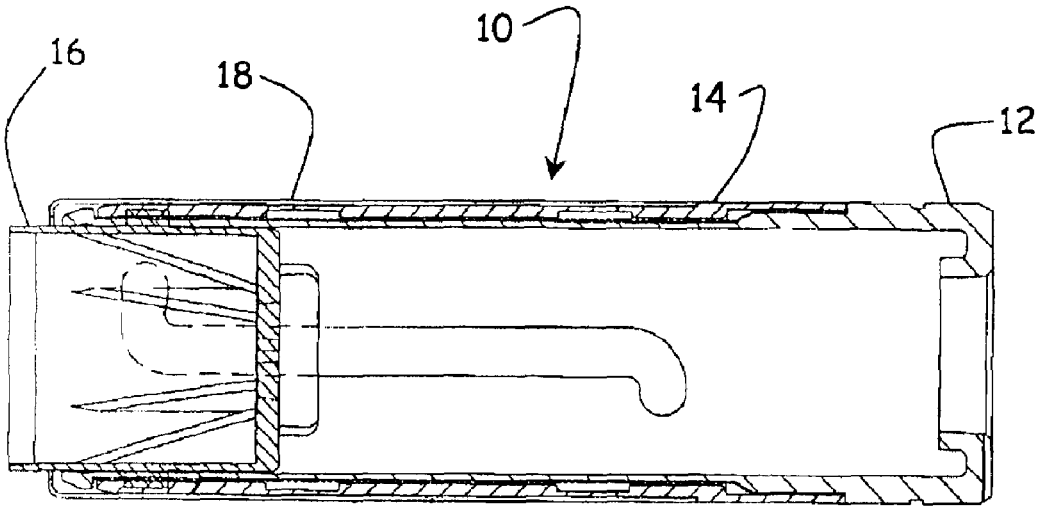
FIG. 2 is a cross section of the cosmetic dispenser of FIG. 1 taken along the line 2-2 in an extended disposition.
Figure 3:
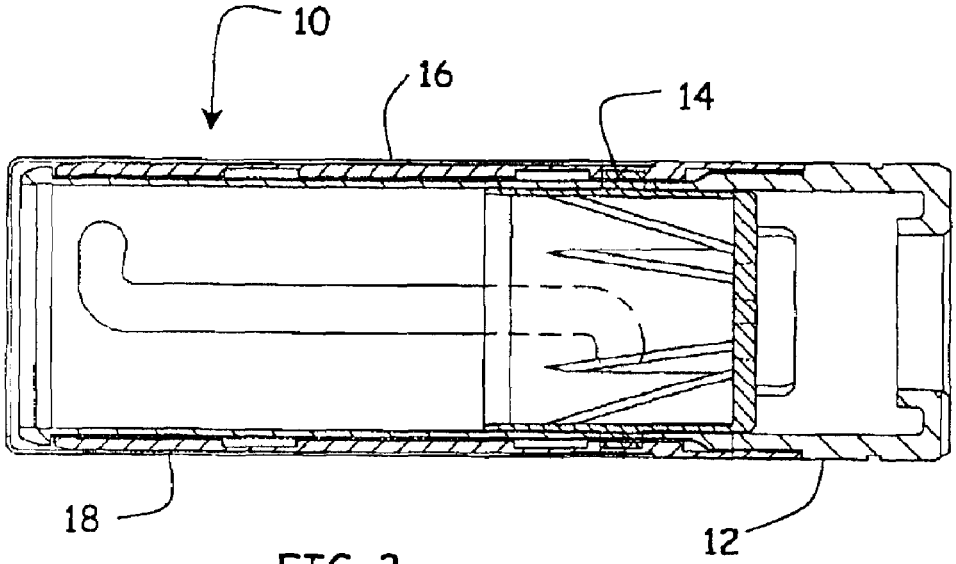
FIG. 3 is a cross section of the cosmetic dispenser of FIG. 1 taken along the line 2-2 in a retracted disposition.

With this in mind and looking more particularly to the accompanying figures, a first exemplary embodiment of a cosmetic dispenser pursuant to the present invention is indicated generally at 10 in FIGS. 1 through 3. The cosmetic dispenser 10 is founded on a tubular innerbody 12 that is rotatably coupled to a spiral member 14. As will be described more fully hereinbelow, a relative rotation between the innerbody 12 and the spiral member 14 yields an axial movement of an elevator cup 16, which is employed to retain a member of lipstick 100, between the extended disposition depicted in FIG. 2 and the retracted disposition depicted in FIG. 3. A tubular shell 18, which can be essentially decorative in nature, can partially or substantially encase the spiral member 14 and, derivatively, the elevator cup 16 disposed therewithin.

For ease of reference, the cosmetic dispenser 10 can be considered to have a proximal end defined as the base of the innerbody 12 while the tip of the tubular shell 18 can be considered to define a distal end of the cosmetic dispenser 10. Each component of the cosmetic dispenser 10 can be described under that convention. It should be noted that, while the term member is employed in relation to the spiral member 14 and possibly other components of the cosmetic dispenser 10, each could be formed unitarily as a single piece of material or from multiple subcomponents joined by any effective method to form the respective structure. Just as clearly, except as otherwise described or claimed, the innerbody 12, the spiral member 14, the elevator cup 16, and the tubular shell 18 can be formed from any suitable material and by any effective method.

Figure 4:
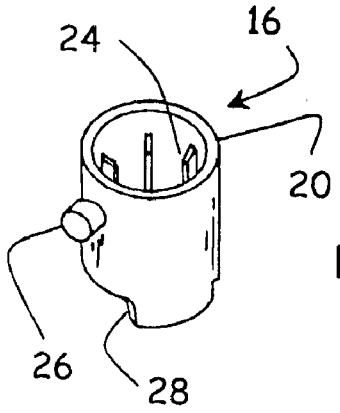
FIG. 4 is a perspective view of an elevator cup pursuant to the present invention.
Figure 5:
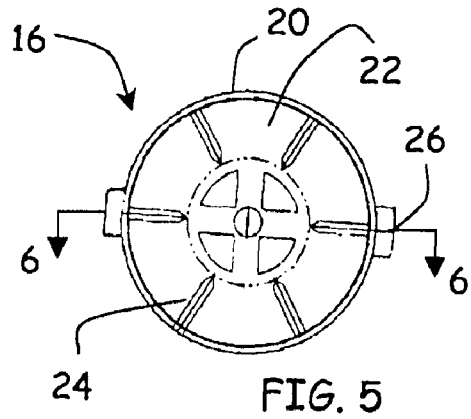
FIG. 5 is a top plan view of the elevator cup of FIG. 4.
Figure 6:
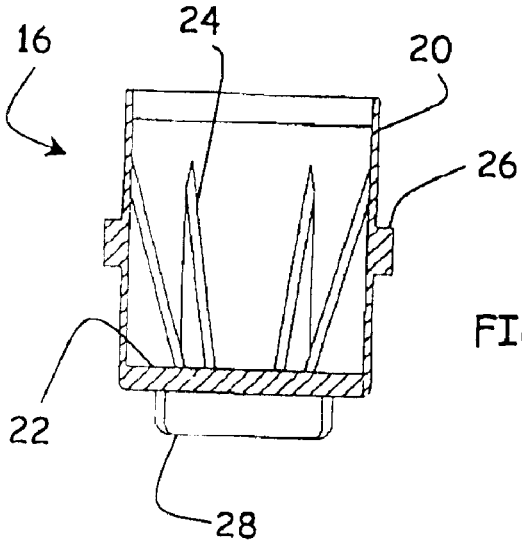
FIG. 6 is a cross section of the elevator cup taken along the line 6-6 in FIG. 5.
Figure 7:
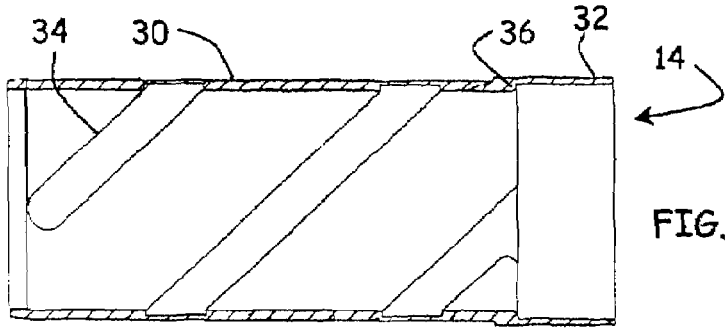
FIG. 7 is a cross section of a spiral member pursuant to the invention disclosed herein taken along the line 2-2 in FIG. 1 but apart from the remainder of the cosmetic dispenser.
Figure 8:
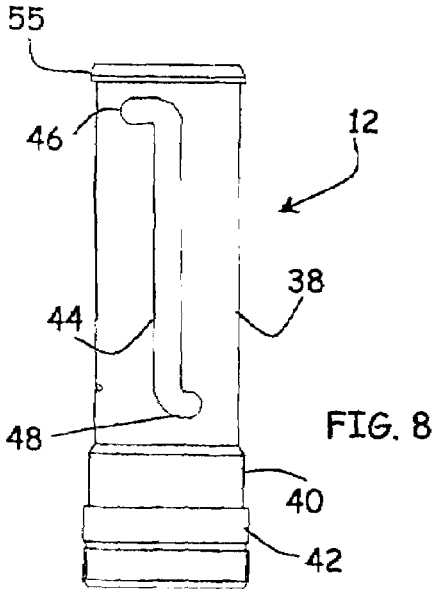
FIG. 8 is a view in front elevation of an innerbody under the instant invention.

The elevator cup 16 is shown apart from the remainder of the cosmetic dispenser 10 in FIGS. 4 through 6. There, the elevator cup 16 can be seen to have an open inner volume for receiving a proximal portion of a member of lipstick 100 (not shown in FIGS. 4 through 6). The open inner volume is defined by an annular peripheral wall 20 and a proximal base portion 22. Opposed tongues 28 can project proximally from the proximal base portion 22 of the elevator cup 16 to improve the axial alignment of the elevator cup 16 in relation to the innerbody 12 and the cosmetic dispenser 10 in general.

A plurality of resiliently deflectable fins 24 project inwardly from the peripheral wall 20. The fins 24 can project along radii of the elevator cup 16 Alternatvelv, the fins 24 could project in an angled relationship relative to tangents of the annular peripheral wall 20. As FIG. 6 shows most clearly, the fins 24 can have a distal taper for enabling a most efficient receipt and engagement of the member of lipstick 100. In this example, the fins 24 are longitudinally aligned with the elevator cup 16 and the cosmetic dispenser 10 in general. One or more elevator lugs 26 can project outwardly from the elevator cup 16, such as from the peripheral wall 20, for engaging the innerbody 12 and the spiral member 14 as will be described below. In the depicted example, first and second elevator lugs 26 project from opposed sides of the elevator cup 16 from a mid-portion thereof.

With combined reference to FIGS. 2 through 4, one can perceive that the spiral member 14 has a proximally disposed skirt 32, which can be flexible, and a distally disposed body portion 30. While the skirt 32 in the present embodiment is depicted as comprising the proximal portion of the spiral member 14, it will be noted that the skirt 32 could be otherwise disposed, such as at a mid-portion or at the distal end of the spiral member 14. The body portion 30 has a smooth outer wall surface and an inner wall surface with spiral threads, which in this example comprise spiral channels 34, communicating there along. It will be noted that, although spiral channels 34 are depicted in the instant embodiment, the spiral threads alternatively could comprise spiral ridges or any other spiral arrangement. In any case, spiral channels 34 can be disposed in general opposition to one another thereby to enable a receipt and engagement of the opposed elevator lugs 26.

The inner diameter of the distal body portion 30 of the spiral member 14 and the outer diameter of the peripheral wall 20 of the elevator cup 16 can be calibrated to allow the elevator cup 16 to slide axially in relation to the spiral member 14, such as by having the outer diameter of the peripheral wall 20 be slightly less than the inner diameter of the distal body portion 30. Similarly, the elevator lugs 26 and the opposed spiral channels 34 can be dimensioned to enable a sliding of the elevator lugs 26 along the spiral channels 34, such as by having the distance between the outer tips of the elevator lugs 26 slightly less than the diameter established by the spiral channels 34.

The tubular innerbody 12 is shown apart from the remainder of the cosmetic dispenser 10 in the varied views of FIGS. 8 through 12. The innerbody 12 has a distally disposed body portion 38 for being received into the body portion 30 of the spiral member 14. The body portion 38 of the innerbody 12 has an outer diameter slightly less than the inner diameter of the body portion 30 of the spiral member 14. The body portion 38 of the innerbody 12 is fixed at its proximal end to a shoulder portion 40, such as by being formed integrally therewith. In this example, the shoulder portion 40 is broader than the body portion 38 of the innerbody 12 but is sized for being received within the skirt 32, such as by having an outer radius or diameter that is slightly smaller than the inner radius or diameter of the skirt 32. The shoulder portion 40 is fixed at its proximal end to a knob portion 42, such as by being formed integrally therewith. The knob portion 42 is broader than the inner diameter of the skirt 32 of the spiral member 14 and can have an outer diameter approximately equal to the outer diameter of the skirt 32.

Under this arrangement, the innerbody 12 can be rotatably engaged with the spiral member 14 as shown, for example, in FIGS. 2 and 3. The body portion 38 of the innerbody 12 can be received within the body portion 30 of the spiral member 14 while the shoulder portion 40 of the innerbody 12 can be disposed within the skirt 32 of the spiral member 14. The knob portion 42 of the innerbody 12 can project proximally beyond the spiral member 14 to enable a manual rotation of the innerbody 12 in relation to the spiral member 14. The body portion 38 of the innerbody 12 can have a retaining lip 55 at the distal end thereof for mechanically retaining the innerbody 12 relative to the spiral member 14.

The innerbody 12 has first and second longitudinal tracks 44 and 50 that communicate along a substantial length of the body portion 38. The longitudinal tracks 44 and 50 are disposed in general opposition and pass entirely through the body portion 38. With this, the elevator lugs 26 of the elevator cup 16 can pass through the longitudinal tracks 44 and 50 to engage the opposed spiral channels 34 of the spiral member 14. The first longitudinal track 44 can have closed proximal and distal ends while the second longitudinal track 50 can have a closed proximal end and an aperture 56 at the distal end thereof for enabling a receipt of the elevator lugs 26 of the elevator cup 16 and for enabling a radial compression of the body portion 38 of the innerbody 12 during an insertion of the body portion 38 of the innerbody 12 into the body portion 30 of the spiral member 14.

The first and second longitudinal tracks 44 and 50 can have distal lateral track segments 46 and 52 respectively at the distal ends thereof and proximal lateral track segments 48 and 54 at the proximal ends thereof. The distal lateral track segments 46 and 52 can be employed to lock the elevator cup 16 in the extended disposition of FIG. 2, and the proximal lateral track segments 48 and 54 can lock the elevator cup 16 in the retracted disposition of FIG. 3. With this, inadvertent movement, including retraction, of the elevator cup 16 and the member of lipstick 100 can be prevented.

With the cosmetic dispenser 10 fully assembled, the elevator cup 16, and thus a member of lipstick 100, can be manipulated between the extended configuration depicted in FIG. 2 and the retracted configuration depicted in FIG. 3 by a rotation of the innerbody 12 in relation to the spiral member 14. To do so, a user could grip the innerbody 12, such as by gripping the knob portion 42 with a first hand, and then engage the spiral member 14 either directly or by use of the shell 18, such as with a second hand. Next, torque sufficient to rotate the innerbody 12 in relation to the spiral member 14 can be applied. As the innerbody 12 is rotated in relation to the spiral member 14, the elevator cup 16 will be prevented from rotating in relation to the innerbody 12 by engagement of the lugs 26 with the longitudinal tracks 44 and 50. With that, the elevator lugs 26 will slide along the helical tracks 34 to yield an axial movement of the elevator cup 16 and the member of lipstick 100. Relative rotation in a first direction will induce extension while relative rotation in a second, opposite direction will induce a retraction of the elevator cup 16 and the member of lipstick 100.

As noted previously, a cosmetic dispenser that extends and retracts smoothly and with consistent torque characteristics, such as by the provision of frictional drag, tends to impart a firm and luxurious feel to the user that gives the perception of quality as to the cosmetic dispenser and the product retained thereby. The present invention can incorporate a means for inducing a frictional drag between the spiral member 14 and the innerbody 12 to provide the desired torque characteristics.

As described above, the shoulder portion 40 of the innerbody 12 can have an outer radius or diameter slightly less than the inner radius or diameter of the skirt 32 of the spiral member 14 to allow a marginal rotational clearance therebetween. One or more frictional protuberances 58 can project radially outwardly from the innerbody 12 to cause the shoulder portion 40 to have an effective radius or diameter including the frictional protuberance 58 greater than the nonbiased inner radius or diameter of the skirt 32 of the spiral member 14. The frictional protuberance 58 or protuberances 58 can cause the associated segment of the shoulder portion 40 to have an effective circumference greater than the inner circumference of the skirt 32 of the spiral member 14. Within the terms of the present disclosure, the nonbiased inner radius or diameter of the skirt 32 can be considered to comprise the inner radius or diameter of the skirt 32 absent any deformation, such as by the action of the frictional protuberance 58 or protuberances 58. In the present embodiment, just one frictional protuberance 58 is employed.

Figure 9:
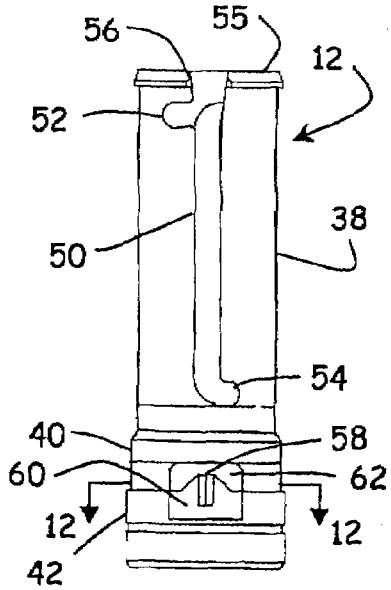
FIG. 9 is a view in rear elevation of the innerbody of FIG. 8.
Figure 10:
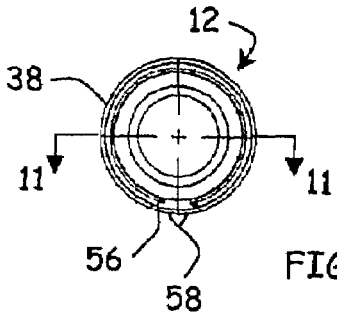
FIG. 10 is a top plan view of the innerbody.
Figure 11:
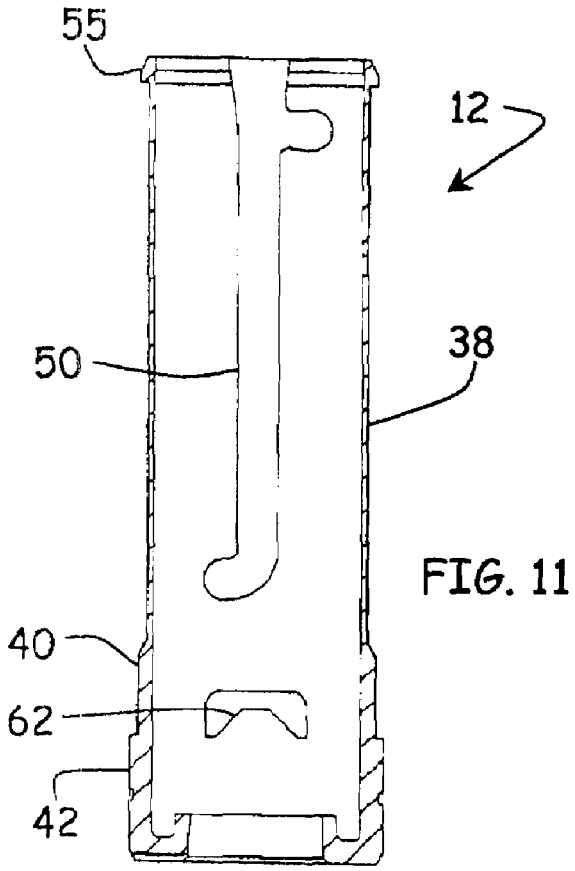
FIG. 11 is a longitudinal cross section of the innerbody taken along the line 11-11 in FIG. 10.
Figure 12:
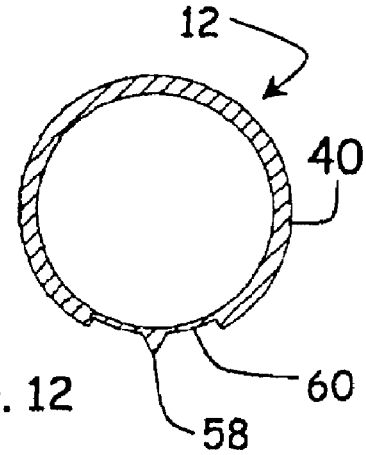
FIG. 12 is a lateral cross section of the innerbody taken along the line 12-12 in FIG. 9.

As FIGS. 9 and 12 show most clearly, the frictional protuberance 58 can be retained relative to a thinned wall portion 60. The thinned wall portion 60 and the frictional protuberance 58 can span longitudinally into the shoulder portion 40 and into the knob portion 42 such that the frictional protuberance 58 will engage only a most proximal segment of the flexible skirt 32. The thinned wall portion 60 and the frictional protuberance 58 can be substantially inflexible to prevent their deflection when engaging the skirt 32 of the spiral member 14. An open area 62 can be distally disposed relative to the thinned wall portion 60 and the frictional protuberance 58.

Figure 13:
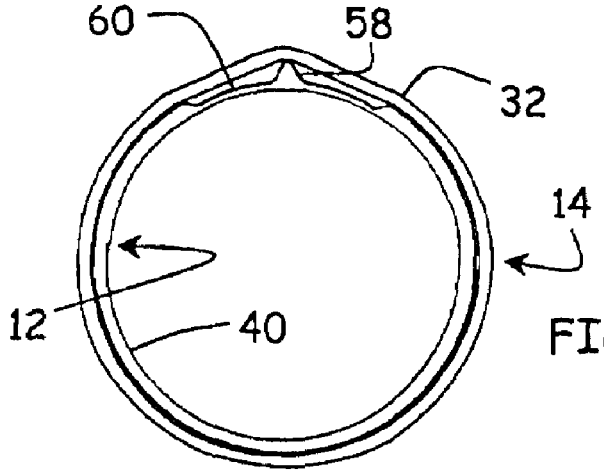
FIG. 13 is a lateral cross section of the cosmetic dispenser taken along the line 13-13 in FIG. 1.

As FIG. 13 shows, when the innerbody 12 and the spiral member 14 are coupled in such a construction, the frictional protuberance 58 of the innerbody 12 will engage the proximal portion of the skirt 32 of the spiral member 14. The flexibility of the skirt 32 will enable it to distort to accommodate the frictional protuberance 58. The frictional protuberance 58 will tend to impart a frictional drag during a rotation of the skirt 32 and the spiral member 14 in relation to the frictional protuberance 58 and the innerbody 12. It will be noted that, while the segment of the skirt 32 disposed adjacent to the frictional protuberance 58 will be bowed outwardly, at least a portion of the remainder of the flexible skirt 32 will tend to be pulled inwardly toward the shoulder portion 40 of the innerbody 12 as is shown in FIG. 13. The flexible skirt 32 can be pulled into engagement with the shoulder portion 40 thereby to cause the drawn-in portion of the flexible skirt 32 to conform to the annular outer surface of the shoulder portion 40.

As a result, the swivel torque required to produce a rotation between the innerbody 12 and the spiral member 14 will tend to remain consistent and above a given minimum as the segment of the skirt 32 not adjacent to the frictional protuberance 58 will be drawn to a round configuration by engagement with the shoulder portion 40 of the innerbody 12. Furthermore, any possible temporary deformation of the skirt 32 will be localized in relation to the frictional protuberance 58 such that a rotation of the innerbody 12 in relation to the spiral member 14 will cause the frictional protuberance 58 to engage the remaining segment of the skirt 32 that was previously drawn inwardly. Additionally, since the frictional protuberance 58 slides along the same portion of the skirt 32 and does not tend to move axially there along, the frictional drag will tend to be generally consistent, which represents an improvement over many cosmetic dispensers of the prior art. Still further, the amount of frictional drag can be controlled by a calibration of, among other things, the thickness and flexibility of the skirt 32, the differences between the effective radius and circumference of the innerbody 12 in the location of the frictional protuberance 58 and the inner radius and circumference of the corresponding portion of the skirt 32, and the materials from which the innerbody 12 and the spiral member 14 are formed.

The dimensions of the components of the cosmetic dispenser 10 could vary within the scope of the invention as could the materials from which they are formed. Nonetheless, the description of possible dimensions and materials in relation to one potential embodiment of the cosmetic dispenser 10 may assist in a better understanding of the invention. For convenience, reasonable tolerances will be assumed. It will be noted that the particular dimensions and dimensional relations will vary depending on the needs and goals of the manufacturer and on the materials from which the components are formed.

In one example, the body portion 38 of the adapter member 12 can have an inner diameter of 13.61 mm (0.536 inches) and an outer diameter of 14.53 mm (0.572 inches). The body portion 30 of the spiral member 14 can have an inner diameter of 14.67 mm (0.578 inches) and an outer diameter of 16.15 mm (0.636 inches) with a wall thickness of approximately 0.46 mm (0.018 inches). The skirt 32 of the spiral member 14 can have a nonbiased inner diameter of 15.80 mm (0.622 inches) and an outer diameter of 16.61 mm (0.654 inches) with a wall thickness of approximately 0.405 mm (0.016 inches). The shoulder portion 40 of the innerbody 12 can have an outer diameter of 15.65 mm (0.616 inches) while the frictional protuberance 58 can project to establish an effective diameter of 16.00 mm (0.630 inches), which is 0.20 mm (0.008 inches) greater than the nonbiased inner diameter of the skirt 32. In one presently contemplated embodiment, the innerbody 12 and the spiral member 14 can be formed unitarily from high impact polystyrene plastic (HIPS). The elevator cup 16 could be formed from polyoxymethylene (POM). The tubular shell 18 can be formed from a metal, such as aluminum.

Cosmetic dispensers 10 taking advantage of one or more aspects of the aforedescribed embodiments achieve a plurality of advantages over the devices of the prior art. The cosmetic dispenser 10 extends and retracts smoothly and with consistent swivel torque by virtue of the frictional engagement produced by the frictional protuberance 58 engaging and deforming the skirt 32 of the spiral member 14. As a result, the cosmetic dispenser 10 imparts a firm feel to the user thereby providing an impression of quality and luxury in relation to the cosmetic dispenser 10 and the product retained thereby. Furthermore, with the interference fit established by the engaging of the skirt 32 by the frictional protuberance 58, the cosmetic dispenser 10 minimizes perceptible looseness and play between components.

It will be clear that the present invention for a cosmetic dispenser 10 has been shown and described with reference to certain preferred embodiments that merely exemplify the broader invention revealed herein. Certainly those skilled in the art can conceive of alternative embodiments. For instance, those with the major features of the invention in mind could craft embodiments that incorporate one or more major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims may express certain elements as a means for performing a specific function, at times without the recital of structure or material. As the law demands, these claims shall be construed to cover not only the corresponding structure and material expressly described in the specification but also equivalents thereof.

I claim as deserving the protection of Letters Patent:

1. A cosmetic dispenser for producing an axial movement of a volume of cosmetic between an extended dispositon and a retracted disposition, the cosmetic dispenser comprising:

an elevator member with a cosmetic retaining portion;

an innerbody with a proximal portion, a distal portion, an inner wall surface, an outer wall surface, and an open inner volume for receiving at least a portion of the elevator member;

a spiral member with a proximal portion, a distal portion, an inner wall surface, an outer wall surface, and an open inner volume for receiving a portion of the innerbody in a relatively rotatable, mating relationship wherein the spiral member has an annular flexible wall segment with a nonbiased inner radius wherein the flexible wall segment of the spiral member comprises a continuous skirt with a substantially consistent inner radius wherein the skirt comprises the proximal portion of the spiral member and wherein the spiral member has a body portion that comprises the distal portion of the spiral member;

at least one protuberance disposed on the outer wall surface of the innerbody in axial alignment with the flexible wall segment of the spiral member wherein the at least one protuberance establishes an effective radius of the innerbody including the frictional protuberance that is greater than the nonbiased inner radius of the flexible wall segment whereby a deformation of the flexible wall segment of the spiral member and a frictional drag between the innerbody and the spiral member will tend to be produced;

wherein the innerbody has a body portion for being received within the body portion of the spiral member, a shoulder portion for being received within the skirt of the spiral member, and a knob portion disposed proximally to the shoulder portion, wherein the at least one protuberance projects from the shoulder portion, wherein the at least one protuberance and the shoulder portion are substantially inflexible, wherein the shoulder portion is substantially consistent in outer radius and smaller therealong in outer radius without the at least one protuberance than the axially aligned inner radius of the skirt of the spiral member but greater therealong in outer radius than the inner radius of the body portion of the spiral member,wherein the shoulder portion has an axial length substantially equal to an axial length of the skirt of the spiral member, and wherein the wherein the knob portion has an outer diameter greater than an outer diameter of the flexible wall segment of the spiral member whereby the knob portion forms a proximal portion of the cosmetic dispenser; and a means for producing an axial movement of the elevator member in response to a rotation of the innerbody relative to the spiral member.

2. The cosmetic dispenser of claim 1 further comprising at least one longitudinal track disposed in the innerbody and wherein the means for producing an axial movement of the elevator member in response to a rotation of the innerbody relative to the spiral member comprises at least one spiral thread disposed along the inner wall surface of the spiral member in combination with at least one elevator lug that projects from the elevator member for being received through the longitudinal track and into engagement with the at least one spiral thread.

3. The cosmetic dispenser of claim 2 wherein there are first and second longitudinal tracks disposed in general opposition in the innerbody and wherein there are first and second elevator lugs that project in general opposition from the elevator member for being received through the longitudinal tracks in the innerbody.

4. The cosmetic dispenser of claim 2 further comprising a lateral track segment disposed adjacent to each of the distal and proximal ends of the at least one longitudinal track.

5. The cosmetic dispenser of claim 1 further comprising a member of lipstick.

6. The cosmetic dispenser of claim 1 wherein there is only one protuberance that projects from the portion of the innerbody whereby the protuberance tends to bias portions of the flexible wall segment in opposition to the protuberance toward contact and conformity with the outer wall surface of the innerbody.

7. The cosmetic dispenser of claim 6 wherein the shoulder portion of the innerbody has a thinned wall portion disposed adjacent to the protuberance.

8. The cosmetic dispenser of claim 7 wherein the protuberance is generally V-shaped and wherein the protuberance communicates axially along the shoulder portion.

9. The cosmetic dispenser of claim 8 wherein the effective radius established by the protuberance is substantially constant.

10. The cosmetic dispenser of claim 1 further comprising a retaining lip disposed at a distal end of the body portion of the innerbody for rotatably retaining the innerbody in relation to the spiral member.

11. A cosmetic dispenser for producing an axial movement of a volume of cosmetic between an extended disposition and a retracted disposition, the cosmetic dispenser comprising:

an elevator cup defined by a peripheral wall and a base portion wherein at least one elevator lug projects radially from the elevator cup;

an innerbody with a proximal portion, a distal portion, an inner wall surface, an outer wall surface, an open inner volume for receiving at least a portion of the elevator cup. and at least one longitudinal track;

a spiral member with a proximal portion, a distal portion, an inner wall surface, an outer wall surface, an open inner volume for receiving a portion of the innerbody in a relatively rotatable, mating relationship, a continuous annular flexible skirt with a nonbiased inner diameter, and at least one spiral thread disposed along the inner wall surface of the spiral member whereby the at least one elevator lug can be received through the at least one longitudinal track and into engagement with the at least one spiral thread to comprise a means for producing an axial movement of the elevator cup in response to a rotation of the innerbody relative to the spiral member wherein the skirt comprises the proximal portion of the spiral member and wherein the spiral member has a body portion that comprises the distal portion of the spiral member; and at least one protuberance disposed on the outer wall surface of the innerbody in axial alignment with the flexible skirt of the spiral member wherein the at least one protuberance establishes an effective diameter of the innerbody including the frictional protuberance that is greater than the nonbiased inner diameter of the flexible skirt whereby a deformation of the flexible skirt of the spiral member and a frictional drag between the innerbody and the spiral member will tend to be produced;

wherein the innerbody has a body portion for being received within the body portion of the spiral member, a shoulder portion for being received within the skirt of the spiral member, and a knob portion disposed proximally to the shoulder portion, wherein the at least one protuberance projects from the shoulder portion, wherein the at least one protuberance and the shoulder portion are substantially inflexible, wherein the shoulder portion is smaller therealong in outer radius without the at least one protuberance than the axially aligned inner radius of the skirt of the spiral member but greater therealong in outer radius than the inner radius of the body portion of the spiral member, and wherein the wherein the knob portion has an outer diameter greater than an outer diameter of the flexible wall segment of the spiral member whereby the knob portion forms a proximal portion of the cosmetic dispenser.

12. The cosmetic dispenser of claim 11 wherein there are first and second longitudinal tracks disposed in general opposition in the innerbody and wherein there are first and second elevator lugs that project in general opposition from the elevator cup for being received through the longitudinal tracks in the innerbody.

13. The cosmetic dispenser of claim 12 further comprising a lateral track segment disposed adjacent to each of the distal and proximal ends of the at least one longitudinal track.

14. The cosmetic dispenser of claim 11 further comprising a member of lipstick.

15. The cosmetic dispenser of claim 11 wherein the outer diameter of the shoulder portion of the innerbody and the inner diameter of the flexible skirt of the spiral member are generally constant.

16. The cosmetic dispenser of claim 11 wherein there is only one protuberance that projects from the shoulder portion of the innerbody whereby the protuberance tends to bias portions of the flexible wall segment in opposition to the protuberance toward contact and conformity with the outer wall surface of the innerbody.

17. The cosmetic dispenser of claim 16 wherein the shoulder portion of the innerbody has a thinned wall portion disposed adjacent to the protuberance.

18. The cosmetic dispenser of claim 17 wherein the protuberance is generally V-shaped and wherein the protuberance communicates axially along the shoulder portion.

19. The cosmetic dispenser of claim 18 wherein the effective radius established by the protuberance is substantially constant.

20. The cosmetic dispenser of claim 11 further comprising a retaining lip disposed at a distal end of the body portion of the innerbody for rotatably retaining the innerbody in relation to the spiral member.

* * * * *